US011287099B2

(12) United States Patent
Erdl et al.

(10) Patent No.: US 11,287,099 B2
(45) Date of Patent: Mar. 29, 2022

(54) LIGHTING DEVICE FOR A MOTOR VEHICLE

(71) Applicant: Bayerische Motoren Werke Aktiengesellschaft, Munich (DE)

(72) Inventors: Helmut Erdl, Flintsbach (DE); Abdelmalek Hanafi, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/968,220

(22) PCT Filed: Jan. 14, 2019

(86) PCT No.: PCT/EP2019/050732
§ 371 (c)(1),
(2) Date: Aug. 7, 2020

(87) PCT Pub. No.: WO2019/154587
PCT Pub. Date: Aug. 15, 2019

(65) Prior Publication Data

US 2021/0033254 A1 Feb. 4, 2021

(30) Foreign Application Priority Data

Feb. 8, 2018 (DE) ..... 10 2018 201 980.0

(51) Int. Cl.
*F21S 41/32* (2018.01)
*F21S 41/275* (2018.01)
(Continued)

(52) U.S. Cl.
CPC ..... *F21S 41/323* (2018.01); *F21S 41/16* (2018.01); *F21S 41/275* (2018.01); *F21Y 2115/30* (2016.08)

(58) Field of Classification Search
None
See application file for complete search history.

(56) References Cited

U.S. PATENT DOCUMENTS 6,966,675 B2 * 11/2005 Albou ..... F21S 41/43 362/298
2003/0202359 A1 10/2003 Albou
(Continued)

FOREIGN PATENT DOCUMENTS

DE 603 08 989 T2 6/2007
DE 603 17 254 T2 8/2008
(Continued)

OTHER PUBLICATIONS

International Search Report (PCT/ISA/210) issued in PCT Application No. PCT/EP2019/050732 dated Apr. 23, 2019 with English translation (five (5) pages).
(Continued)

*Primary Examiner* — Elmito Breval
(74) *Attorney, Agent, or Firm* — Crowell & Moring LLP

(57) ABSTRACT

A lighting device for a motor vehicle has a laser light source for producing laser light and a converting unit having a reflective converting layer, at which laser light originating from the laser light source is directed, during operation of the lighting device, such that a white light source is produced at the converting layer. A reflector is provided, which has an elliptical reflection surface, which corresponds to a portion of an ellipsoid containing a vertex of the ellipsoid. The reflector is shaped and arranged such that a first focal point of the ellipsoid lies within the white light source and the white light source is optically imaged in the form of a real intermediate image, which includes a second focal point of the ellipsoid, by way of the reflector. The lighting device also has a secondary optical unit, by which a light distribution in the environment of the motor vehicle is produced from the real intermediate image. An aperture for limiting the light distribution in the environment of the motor vehicle is arranged at the location of the real intermediate image.

13 Claims, 1 Drawing Sheet

(51) Int. Cl.
*F21S 41/16* (2018.01)
*F21Y 115/30* (2016.01)

(56) References Cited

U.S. PATENT DOCUMENTS

| | | | | |
|---|---|---|---|---|
| 2004/0130907 | A1 | 7/2004 | Albou | |
| 2005/0105301 | A1 | 5/2005 | Takeda et al. | |
| 2017/0350569 | A1* | 12/2017 | Hager | F21S 41/192 |
| 2018/0023781 | A1* | 1/2018 | Park | F21S 45/49<br>362/84 |
| 2018/0266640 | A1* | 9/2018 | Albou | F21S 41/147 |

FOREIGN PATENT DOCUMENTS

| | | | |
|---|---|---|---|
| DE | 10 2014 208 504 | A1 | 11/2015 |
| DE | 10 2014 226 668 | A1 | 6/2016 |
| DE | 10 2016 108 061 | A1 | 11/2017 |
| EP | 2 461 092 | A2 | 6/2012 |
| JP | 2004-241142 | A | 8/2004 |
| JP | 2008-276958 | A1 | 11/2008 |
| JP | 6266796 | B2 | 1/2018 |

OTHER PUBLICATIONS

German-language Written Opinion (PCT/ISA/237) issued in PCT Application No. PCT/EP2019/050732 dated Apr. 23, 2019 (seven (7) pages).
German-language Search Report issued in German Application No. 10 2018 201 980.0 dated Nov. 14, 2018 with partial English translation (13 pages).

* cited by examiner

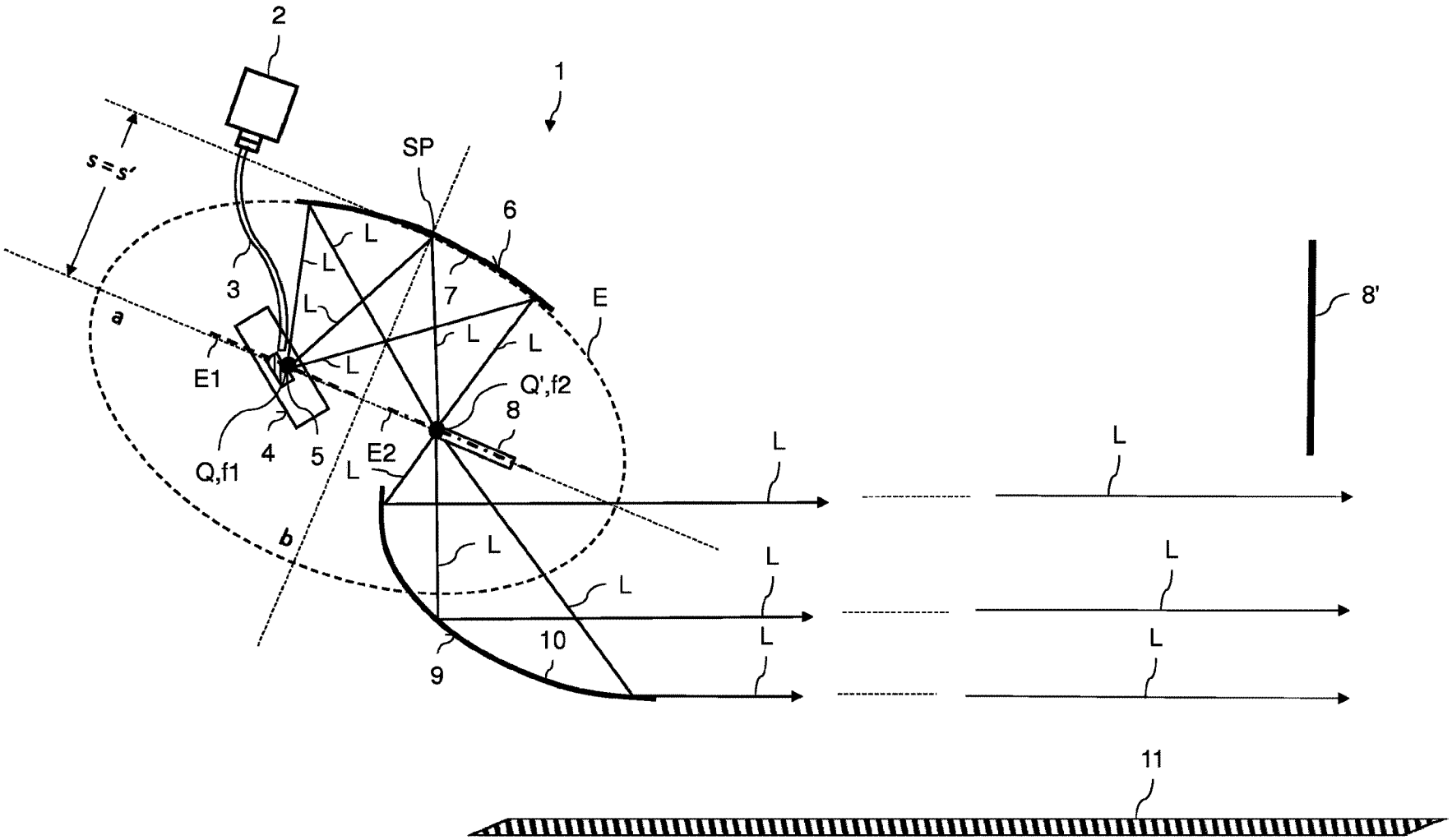
1
2
3
4
5
6
7
8
8'
9
10
11
E
E1
E2
SP
Q,f1
Q',f2
L
a
b
s=s'

LIGHTING DEVICE FOR A MOTOR VEHICLE

BACKGROUND AND SUMMARY OF THE INVENTION

The invention relates to a lighting device for a motor vehicle and a corresponding motor vehicle.

In order to generate white light in motor vehicle lighting devices, such as for example headlights, the use of conversion layers is known. These layers convert monochromatic light into white light. With a suitable optical unit, this white light can be changed into a light distribution in the vicinity of the motor vehicle, such as for example into a dipped beam light distribution or full beam light distribution.

It is often desirable to suitably shadow the light distribution, which is generated by means of a motor vehicle lighting device, in order to, for example, generate a light/dark boundary in a dipped beam light distribution. Conventionally, stops are positioned on or neighboring the conversion layer in this case in order to limit the emission of the white light generated there. This requires firstly a customization of the conversion module which contains the conversion layer, and on the other hand monochromatic reflections of the light incident on the conversion layer are caused by edge scattering at the stop, which again negatively affects the generated light distribution (eye safety).

The object of the invention is to provide a lighting device for a motor vehicle, with which a delimited light distribution can be generated simply and efficiently.

The lighting device according to the invention is provided for a motor vehicle, such as for example a passenger car and also, where appropriate, a truck. Preferably, the lighting device is an exterior light on the motor vehicle. In a preferred embodiment, the lighting device comprises a front headlight or it is a front headlight, with which in particular at least one part of a dipped beam light distribution and/or full beam light distribution is generated. Nonetheless, the lighting device can possibly also represent another light on the motor vehicle, such as for example a taillight.

If interactions between the lighting device and the motor vehicle or components of the motor vehicle are described in the following and in particular in the patent claims, this should always be understood to the effect that the interaction occurs when the lighting device is arranged or installed in the motor vehicle. The components of the lighting device which have a corresponding interaction with the motor vehicle or structural components of the motor vehicle are thus embodied in such a way that the interaction is caused when the lighting device is arranged or installed in the motor vehicle.

The lighting device according to the invention comprises a laser light source for generating preferably monochromatic laser light. In this case, depending on the embodiment, the laser light source can comprise one or, possibly, a plurality of laser diodes. Preferably, the power of the laser light source is between 3 watts and 10 watts. The lighting device further includes a conversion unit or a conversion module, which comprises a reflecting conversion layer. During the operation of the lighting device, light originating from the laser light source is directed onto this conversion layer in such a way that a white light source, which is preferably a point light source, is generated at the conversion layer.

The lighting device according to the invention further comprises a reflector, which comprises an elliptical reflection surface, which corresponds to a subregion of an ellipsoid, which contains one, and preferably only one, vertex of the ellipsoid. The reflector is formed and arranged in such a way that a first focal point of the ellipsoid is located within the white light source and the white light source is optically imaged in the form of a real intermediate image by means of the reflector, wherein the real intermediate image comprises a second focal point of the ellipsoid that differs from the first focal point. The lighting device further comprises a secondary optical unit, by means of which a light distribution is generated in the vicinity of the motor vehicle from the real intermediate image.

Here and in the following, a reflector is generally to be understood as a structural component having a reflection surface, which reflects more than 50% of the incident radiation and thus has a reflectance of more than 50%. In particular, the reflectance is 70% or more, or 80% or more. In a particularly preferred embodiment, the elliptical reflection surface of the above-described reflectors is even higher-reflecting and has a reflectance of 90% or more and preferably of 95% or more. This keeps the luminous flux losses low. Furthermore, the reflection surface of a reflector need not necessarily be a continuous surface, but rather the reflector can also be faceted where appropriate, and consist of a plurality of partially reflecting surfaces.

In the lighting device according to the invention, a stop for limiting the light distribution in the vicinity of the motor vehicle is arranged at the position of the real intermediate image. In this way, the contour of the light distribution can be limited in a simple fashion, without generating undesirable monochromatic reflections, which occur when a stop is arranged at the conversion layer. Furthermore, an optical image with high quality and low luminous flux losses can be ensured by means of using an elliptical reflector. Furthermore, using a laser light source enables the generation of a light distribution with high luminance. Furthermore, the reflecting conversion layer ensures efficient cooling of the white light source, as heat can be dissipated via the rear side of the conversion layer.

In a particularly preferred embodiment of the lighting device according to the invention, the ratio of a first distance, which represents the distance of a target plane from the vertex of the elliptical reflection surface of the reflector, to a second distance, which represents the distance of a source plane from the vertex of the elliptical reflection surface of the reflector, lies in a range of values between 0.8 and 1.2. Here, the first focal point is arranged in the source plane and the source plane spans perpendicular to the semi-axis of the ellipsoid, the axis running through the vertex of the elliptical reflection surface. Furthermore, the second focal point is arranged in the target plane and the target plane spans perpendicular to the semi-axis of the ellipsoid, the axis running through the vertex of the elliptical reflection surface. According to this embodiment, the imaging scale of the optical image effected by means of the reflector lies in the mentioned range of values of the distance ratios. By means of such an imaging scale, an arrangement of the reflector in the lighting device can be achieved, which leads to a small construction depth of the lighting device and allows a high luminous efficacy.

In a particularly preferred embodiment, the ratio of the first distance to the second distance is substantially equal to one. This is in particular effected as a result of the fact that in the pair of the semi-axis of the ellipsoid which runs through the vertex of the elliptical reflection surface and semi-axis of the ellipsoid which runs through the first and second focal point, the semi-axis running through the vertex is the minor semi-axis. By means of this symmetrical layout in the direction of the minor semi-axis, an imaging scale of one is achieved despite a finite distance between the first and second focal point.

In a further preferred embodiment, the lighting device according to the invention comprises an optical light guide, via which laser light originating from the laser light source is guided to the reflecting conversion layer. This enables a flexible positioning of the laser source in the lighting device.

The secondary optical unit can have different embodiments in the lighting device according to the invention. In one variant, the secondary optical unit comprises one or more additional reflectors in addition to the elliptical reflector contained in the lighting device. Alternatively or additionally, the secondary optical unit can also comprise one or more lenses.

In a preferred variant of the embodiment just described, at least one additional reflector and preferably all additional reflectors of the secondary optical unit each have a reflection surface with a reflectance of 90% or more and preferably of 95% or more. Furthermore, preferably at least one lens and in particular all lenses of the secondary optical unit have an anti-reflection coating. In this way, the luminous flux losses are kept low.

In a further preferred embodiment, at least two and in particular all elements selected from the reflector, the stop and at least one part of the secondary optical unit form an integral structural component. The at least one part of the secondary optical unit can also represent the whole secondary optical unit where applicable. Preferably, the at least one part of the secondary optical unit comprises the above-described additional reflector or reflectors or the above-described lens or lenses.

By means of the embodiment of an integral structural component just described, the exact arrangement of the therein integrated optical units in relation to each other is already ensured during the manufacture of the lighting device. Because of this, the adjustment effort for the lighting device is kept very low and a high robustness of the system is guaranteed.

Besides the above-described lighting device, the invention relates to a motor vehicle, which comprises one or more lighting devices according to the invention or preferred variants of these lighting devices.

An exemplary embodiment of the invention is described in depth in the following.

BRIEF DESCRIPTION OF THE DRAWING

FIG. 1 is a schematic section view of an embodiment of a lighting device according to the invention.

DETAILED DESCRIPTION OF THE DRAWING

The invention is explained in exemplary fashion with the aid of a lighting device in the form of a front headlight. This front headlight is rendered only schematically in FIG. 1 and designated by reference sign 1. For reasons of clarity, the housing of the front headlight and its transparent cover pane, via which the front headlight light emerges from the housing, are omitted.

The front headlight 1 comprises a laser light source 2, which generates monochromatic laser light, such as for example blue laser light. For this purpose, the laser light source comprises one or, if necessary, a plurality of laser diodes. This laser light is guided toward a conversion unit or a conversion module 4 via an optical light guide 3 made of one or more optical fibers. By means of the connection of the laser light source 2 via the light guide 3, the laser light source can be arranged at a distance from the rest of the headlight if necessary.

The laser light guided in the light guide 3 exits via the end of the light guide which is arranged at a distance from the laser light source 2, and is incident on a conversion element or a conversion layer 5, which is a constituent part of the conversion module 4. The conversion layer consists of intrinsically known conversion material. For example, a phosphor conversion layer of nitride phosphor, oxynitride phosphor or cerium-doped YAG phosphor is used for a blue/violet laser light source with an emission wavelength of 450 nm/405 nm. The conversion layer converts the laser light that is incident thereon into white light. In this case, the conversion layer is reflecting, i.e., the converted white light leaves the conversion layer from the same side on which the laser light is incident on the conversion layer. The use of a reflecting conversion layer enables efficient cooling of this layer, as heat can be dissipated from the whole rear side of the conversion layer.

In the embodiment in FIG. 1, a substantially point-like white light source is provided by means of the conversion layer 5, which is indicated by a black circle and is designated by the reference sign Q. In this case, the point-like white light source is located in a focal point f1 of the elliptical reflector 6 described further below. The light of the white light source emerges from the conversion unit 4 through a light output window (not shown). The beam path of the white light source is schematically indicated by means of a plurality of solid lines L, which are partially rendered as arrows. The lines represent the route of the light beams of the white light source Q.

In the lighting device in FIG. 1, the light of the white light source Q is incident on a reflector 6, which is rendered in the section and forms a subregion of an (imaginary) ellipsoid E. For a typical distance of 3 to 5 mm between the conversion layer 4 and the light output window, the reflector 6 typically has a diameter between 20 mm and 40 mm. The ellipsoid is likewise shown in the section in FIG. 1 and indicated by a dashed line. On the inner side, the reflector 6 has a reflection surface 7 with a highly-reflecting coating in order to keep power losses in the lighting device low because of this. A single vertex SP of the ellipsoid E is located on the reflection surface 7.

The form and arrangement of the reflector 6 or of the ellipsoid E is selected in such a way that the white light source Q is located in a first focal point f1 of the three focal points of the ellipsoid E so that an optical image of the white light source Q is generated in the form of a real intermediate image Q' at the position of a second focal point f2 of the ellipsoid E, by means of the reflector 6. The real intermediate image is indicated by a black circle in FIG. 1, analogous to the white light source. The axis a running through the two focal points f1 and f2 represents a semi-axis of the ellipsoid E. The axis b running perpendicular through the vertex SP also represents a semi-axis of the ellipsoid E. Here, axis a is the major semi-axis and axis b is the minor semi-axis.

According to the illustration in FIG. 1, the white light source Q lies in a source plane E1, which spans perpendicular to the minor semi-axis b and is indicated by a dashed line. Analogously, the intermediate image Q' lies in a target plane E2, which spans perpendicular to the minor semi-axis b and is indicated by a dashed-dotted line. In the embodiment in FIG. 1, the source plane E1 coincides with the target plane E2. This means that the distance s of the source plane E1 from the vertex SP is exactly as large as the distance s' of the target plane E2 from the vertex SP. The distances s and s' represent the back focal lengths of the optical imaging of the reflector 6. Their ratio determines the imaging scale β of the optical imaging, i.e., β=s'/s applies. The optical imaging of the reflector 6 thus has an imaging scale of one. By means of the previously described embodiment and arrangement of the reflector 6, in which the minor semi-axis b extends through the reflection surface 7, a much lower construction depth of the lighting device 1 can be achieved, as the two focal points f1 and f2 can be positioned near to each other.

As already mentioned, a real intermediate image Q' is generated at the second focal point f2 by the reflector 6. From this intermediate image, a light distribution is generated by means of a secondary optical unit in the form of a further curved reflector 9 with reflection surface 10, the light distribution being cast onto the road 11 by the motor vehicle. Depending on the embodiment, a dipped beam and/or a full beam light distribution can be generated as a light distribution. Thus, a light distribution with very high luminance is achieved by using laser light.

An aspect of the embodiment in FIG. 1, which is essential to the invention, is that a stop 8 is positioned in the vicinity of Q', which limits the intermediate image Q' and thus effects shadowing, which in turn manifests itself in a dark region in the light distribution, as indicated by the vertical line 8'. With the stop, the light distribution that is cast onto the road can be suitably limited. For example, a suitable light/dark boundary can be generated when a dipped (low) beam light distribution is generated by means of a corresponding stop shape, thereby preventing blinding of approaching road users. Also, in the case that the headlight generates a glare-free full (high) beam by means of a variable headlight adjustment, a glare-free region of the full beam is realized by means of the stop 8.

By means of using the stop 8 in the vicinity of the intermediate image Q', shadowing is effected very simply and flexibly, without needing to make changes to the conversion module 4. Furthermore, undesirable monochromatic reflections due to scattering of laser light at the stop edges are prevented.

In a preferred variant of the embodiment just described, at least two elements selected from the reflector 6, the stop 8 and the reflector 9 form a monolithic structure, which for example can be achieved by means of the integral embodiment of these elements by means of injection molding. In this way, exact relative positioning of optical elements is ensured, without these having to be adjusted relative to each other in a complex fashion. Preferably a holder also has an integral embodiment with the elements mentioned, in which the conversion module 4 is positioned, whereby the adjustment effort is further reduced.

The lighting device in FIG. 1 generates an optical image with the reflector 6, the imaging scale of which has the value 1. However, the invention is not restricted to an arrangement in which the imaging scale is equal to one. Rather, reflectors with other imaging scales can also be used in the lighting device according to the invention. For a low construction depth of the lighting device according to the invention, the imaging scale should preferably be between 0.8 and 1.2.

The previously described embodiments of the invention have a number of advantages. In particular, a motor vehicle lighting device with lower construction depth is provided. By means of using a reflector with a high refractive power, short focal lengths and low self-shadowing and an almost aberration-free image are thus ensured, despite a small construction space. By arranging the stop in the plane of the intermediate image, it is possible to prevent monochromatic diffraction effects which occur when positioning the stop at the conversion layer because of light scattering at the stop edge. By using a laser light source, the generation of luminous fluxes with a high luminance is further ensured. Optionally, the adjustment effort can be minimized or the problem of an increased requirement for the adjustment precision can be controlled by means of a monolithic structure, in which a plurality of elements of the lighting device form an integral structural component. Furthermore, using a reflecting conversion layer enables very good cooling of this layer.

REFERENCE SIGNS

1 lighting device
2 laser light source
3 light guide
4 conversion unit
5 conversion layer
6 reflector
7 elliptical reflection surface
8 stop (aperture)
8' dark region
9 reflector
10 reflection surface
11 road
Q white light source
Q' real intermediate image
E ellipsoid
SP vertex
f1 first focal point
f2 second focal point
a major semi-axis
b minor semi-axis
s, s' back focal lengths
L light beams

What is claimed is:

1. A lighting device for a motor vehicle, comprising:

a laser light source for generating laser light;

a conversion unit comprising a reflecting conversion layer, onto which, during operation of the lighting device, laser light originating from the laser light source is directed such that a white light source is generated at the conversion layer;

a reflector comprising an elliptical reflection surface corresponding to a subregion of an ellipsoid containing a vertex of the ellipsoid, wherein the reflector is formed and arranged such that a first focal point of the ellipsoid is located within the white light source, all light beams reflected by the reflector converge at a second focal point of the ellipsoid, and the white light source is optically imaged in the form of a real intermediate image via the reflector, the real intermediate image being formed at the second focal point of the ellipsoid; and a secondary optical unit, by which a light distribution is generated in a vicinity of the motor vehicle from the real intermediate image, wherein a stop for limiting the light distribution in the vicinity of the motor vehicle is arranged at a position of the real intermediate image.

2. The lighting device according to claim 1, wherein a ratio of a first distance, which represents the distance of a target plane from the vertex of the elliptical reflection surface of the reflector, to a second distance, which represents the distance of a source plane from the vertex of the elliptical reflection surface of the reflector, is located in a range of values between 0.8 and 1.2, the first focal point is arranged in the source plane and the source plane spans perpendicular to the semi-axis of the ellipsoid, the axis running through the vertex of the elliptical reflection surface, and the second focal point is arranged in the target plane and the target plane spans perpendicular to the semi-axis of the ellipsoid, the axis running through the vertex of the elliptical reflection surface.

3. The lighting device according to claim 2, wherein the ratio of the first distance to the second distance is substantially equal to one.

4. The lighting device according to claim 3, wherein of the pair of the semi-axis of the ellipsoid which runs through the vertex of the elliptical reflection surface and the semi-axis of the ellipsoid which runs through the first and second focal point, the semi-axis running through the vertex is the minor semi-axis.

5. The lighting device according to claim 1, wherein the lighting device comprises a front headlight for a motor vehicle and is configured to generate at least one part of a dipped beam light distribution and/or full beam light distribution as a light distribution in the vicinity of the motor vehicle.

6. The lighting device according to claim 1, wherein the elliptical reflection surface of the reflector has a reflectance of 90% or more.

7. The lighting device according to claim 1, wherein the elliptical reflection surface of the reflector has a reflectance of 95% of more.

8. The lighting device according to claim 1, further comprising:

an optical light guide, via which laser light originating from the laser light source is guided to the reflecting conversion layer.

9. The lighting device according to claim 1, wherein the secondary optical unit comprises one or more additional reflectors and/or one or more lenses.

10. The lighting device according to claim 9, wherein at least one additional reflector has a reflection surface with a reflectance of 90% or more, and at least one lens has an anti-reflection coating.

11. The lighting device according to claim 9, wherein at least one additional reflector has a reflection surface with a reflectance of 90% or more, or at least one lens has an anti-reflection coating.

12. The lighting device according to claim 1, wherein at least two elements selected from a group comprising the reflector, the stop and at least one part of the secondary optical unit, form an integral structural component.

13. A motor vehicle, comprising one or more lighting devices according to claim 1.

* * * * *